United States Patent [19]

Baggett

[11] Patent Number: 4,811,845

[45] Date of Patent: Mar. 14, 1989

[54] MEDICATION COMPLIANCE PACKAGING SYSTEM AND PROCEDURE

[76] Inventor: JoBeth Baggett, 701 McCormick, Shreveport, La. 71104

[21] Appl. No.: 105,109

[22] Filed: Oct. 6, 1987

[51] Int. Cl.[4] ..... B65D 85/56; B65D 83/04

[52] U.S. Cl. ..... 206/534; 383/106; 383/37; 116/308

[58] Field of Search ..... 383/106, 37; 206/459, 206/534; 116/308

[56] References Cited

U.S. PATENT DOCUMENTS

| | | | |
|---|---|---|---|
| 3,497,982 | 3/1970 | Schulz . | |
| 3,826,222 | 7/1974 | Romick . | |
| 4,038,937 | 8/1977 | Moe . | |
| 4,148,273 | 4/1979 | Hollingsworth et al. . | |
| 4,189,053 | 2/1980 | Stagnitto et al. . | |
| 4,318,477 | 3/1982 | Kerpe . | |
| 4,326,359 | 4/1982 | Tabacchi . | |
| 4,473,156 | 9/1984 | Martin | 206/534 |
| 4,526,474 | 7/1985 | Simon . | |
| 4,573,580 | 3/1986 | Messer . | |
| 4,640,560 | 2/1987 | Blum . | |

OTHER PUBLICATIONS

"Drug Packaging and Medication Compliance in Home Care: The Pharmacist's Expertise," M. V. Feinberg, U.S. Pharmacist, pp. 31–39, Oct. 1987.

*Primary Examiner*—William Price

*Attorney, Agent, or Firm*—Nixon & Vanderhye

[57] ABSTRACT

A set of first containers each bearing indicia indicative of the day of the week is provided. A plurality of second containers for disposition in each of the first containers bears indicia indicative of the time of day at which the medication disposed within the second container is to be taken by a patient. The second containers are disposed in chronological sequence in the first containers and are exposed to view through a window formed in the first container in chronological order of their removal from the first container. Thus, the time for taking the medication each day of the week is indicated by viewing the indicia of the second containers through the window of the each container.

11 Claims, 2 Drawing Sheets

MEDICATION COMPLIANCE PACKAGING SYSTEM AND PROCEDURE

BACKGROUND AND SUMMARY OF THE INVENTION

The present invention relates to a packaging system and procedures for ensuring compliance with medication schedules and particularly relates to a packaging system and procedures for ensuring that the patient receives accurate doses of the required medication at the scheduled times.

It has long been recognized in the medical profession that the prognosis and stability of a patient is at least in part a direct result of compliance with his or her prescribed course of medication. Medications for various ailments are generally prescribed for ingestion at certain periodic intervals or in connection with certain events occurring during the day, for example, mealtimes, bedtime or the like. Other medications may be non-specific as to the time of day in which they are taken. Vitamins, for example, fall into this category. Where patients have two or more medications to be taken at various times of the day, it is frequently difficult to remember to take the prescribed doses at the scheduled times during the day or subsequently to remember whether or not all doses were taken at a previously scheduled time. In the case of elderly or debilitated patients it is difficult, if not impossible, for the patients or for those individuals responsible for their care to determine which medications have been taken, which have been omitted or which may have been duplicated during any given day. In certain instances, accidental over-medication occurs because there is no record of whether or not a medication has already been taken. For example, the patient may assume that the medication was not taken when in fact it was, and then take an additional dose, resulting in over-medication. Conversely, under-medication may occur. For example, a patient may assume the prescribed medication was taken at the scheduled time, when in fact it was not The problem is additionally significant, particularly in the case of elderly or debilitated individuals, even apart from whether the medications are taken or not on the scheduled basis, as it may affect the lifestyle or quality of the individual's life. For example, a major factor in the decision to provide in-home care or to choose institutional care for the elderly or the debilitated is the difficulty of assuring accurate dosing of medications without constant supervision and record keeping. Thus, in many cases, the medical prognosis and lifestyle of the individual evolve about the problem of assuring the accuracy and timeliness of the medication and verification that the medication was in fact timely taken to preclude over-medication or under-medication.

In accordance with the present invention, there is provided a medication compliance procedure and packaging system for use in following such procedure. As a first step in this procedure, all of the prescription and over-the-counter medications required by the patient are reviewed with the patient and his or her physician or pharmacist, with a view towards organizing the routine for ingesting the medication consistent with the patient's routine or lifestyle. For example, the normal times for rising, taking meals, bedtime, etc., the number of meals per day and other lifestyle factors are first determined. Medications which are required to be given at certain times of the day are then listed on a dosage schedule, with the objective of having as few dosage times per day as possible. Once the dosage schedule is established, other drugs which are non-specific to the time of day, are entered into the schedule at convenient times consistent with the number and type of medications to be given at any one time and the importance of taking the medication in relation to mealtimes.

A list is then prepared for the medications to be taken at each scheduled dosage time. The scheduled dosage times are then provided as part of indicia on a first container for use on a specified day. The first container preferably contains a plurality of separate second containers, each containing all of the prescribed and over-the-counter medication scheduled for administration at a particular time during that day. That is, the first indicia associated with the first container indicates the day on which the medication is to be taken. The second containers contain the respective medications, which are to be taken at prescribed times during that day. Indicia is provided on the second containers, setting forth the time that medication therein is to be taken. Optionally, the nature of that medication may also be listed, for example, the type of medication and quantity to be taken at that time.

These second containers are inserted into the first container, preferably in an orderly sequence such that the second containers may be removed from the first container in known chronological sequence. Preferably, the first container has a window or at least a portion thereof which is transparent in order to view the indicia of the second containers which indicate the time at which the medication is to be taken that day. Thus, upon removal of the second container having the first medication of the day, the time for the next medication, as indicated by the indicia on the chronologically next second container, will appear through the window or transparent material of the first container.

In this manner, the patient is provided an indication of the time at which the next medication should be taken that day. The absence of a second container in the first container and bearing indicia of an earlier time will indicate that the medication in such second container has been taken. Conversely, the existence of a second container within the first container bearing an earlier indicia of time demonstrates that the medication therein was not taken at such time, enabling the patient to then take the medication, if appropriate, without fear of taking the medication twice. Thus, both accidental under-medication and over-medication are prevented.

The first containers hereof are provided preferably in a group or set of seven containers, each having indicia indicating a different day of the week. A plurality of second containers are provided and bear indicia indicative of the dosage times for each day of the week and are inserted into the appropriate first containers, whereby a medication compliance set useful for a week's medication is provided.

In accordance with the preferred embodiment of the present invention, there is provided a medication compliance packaging system comprising a first container, indicia carried by the first container indicative of a day of the week, a plurality of second containers for disposition within the first container and adapted to contain medication, and indicia carried by the second containers indicative of the times of the day that the respective medications contained therein are to be taken by a patient whereby medications may be accurately dosed from the packaging system at the proper time during that day. Preferably, the first container has at least in part a portion thereof defining a window for viewing the interior of the first container whereby the portion of the second container bearing indicia indicating the dosage time for that day may be exposed to view through the window. Additionally, the second containers are disposed in the first container in chronological sequence such that as the second containers are individually removed therefrom in chronological sequence, the indicia of the second container next to be removed visually appears through the window of the first container.

In accordance with another aspect of the present invention, there is provided a medication compliance packaging system comprising a set of first containers, indicia carried by the first containers indicative of successive days of the week, respectively, a plurality of second containers disposed within each of the first containers and adapted to contain medication, and indicia carried by each of the second containers indicative of the time of day that the medication contained therein is to be taken by a patient whereby medications may be accurately dosed at the proper time during each day of the week.

In a still further aspect of the present invention, there is provided a medication compliance procedure comprising the steps of providing a first container, providing indicia for the first container indicative of the day of the week, providing a plurality of second containers, disposing medication in each of the second containers, locating the second containers in the first container, and providing indicia for the second containers indicative of the times of day that the respective medications contained therein are to be taken by the patient whereby medication can be accurately dosed at the scheduled times during that day.

Accordingly, it is a primary object of the present invention to provide a novel and improved medication compliance packaging system and procedure which readily and easily enables the patient to comply with the prescribed dosage and dosage schedule, prevents accidental over-medication and under-medication and affords verification that the medication has been taken.

It is also another object of the present invention to provide a medication compliance packaging system in the form of lightweight, substantially unbreakable, flexible packages convenient for use at home or during travel and which may be readily and easily carried by the patient.

These and further objects and advantages of the present invention will become more apparent upon reference to the following specification, appended claims and drawings.

BRIEF DESCRIPTION OF THE DRAWING FIGURES

DETAILED DESCRIPTION OF THE DRAWING FIGURES

Reference will now be made in detail to the present preferred embodiment of the invention, an example of which is illustrated in the accompanying drawings.

Figure 1:
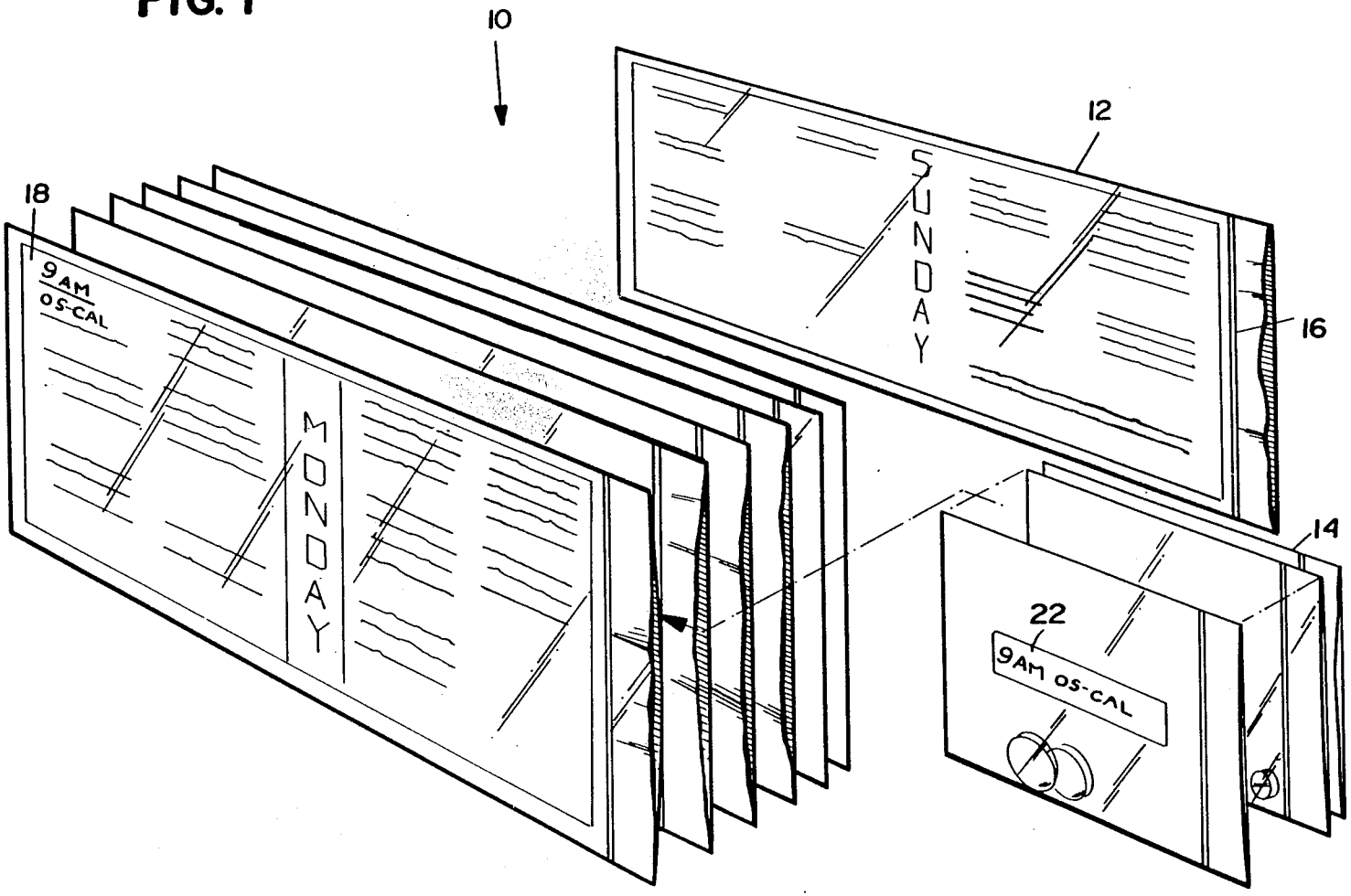
FIG. 1 is a perspective view of a medication compliance packaging system constructed in accordance with the present invention.

Referring now to FIG. 1, there is illustrated a medication compliance packaging, generally designated 10, comprised of a set of first containers 12 and a plurality of second containers 14 adapted to be received within the first containers 12. Containers 12 are preferably in the form of flexible envelopes formed of a transparent plastic material, although it will be appreciated that other types of material, such as paper, may be used in lieu of transparent plastic materials. It will also be appreciated that other shapes and configurations of the containers 12 may be provided within the scope of the present invention. Each of first containers 12, in the illustrated form, constitutes an elongated envelope sealed along three sides and releasably closed along a fourth side or end edge by a releasable closure means 16. Preferably, the closure means is resealable after opening. The closing means may take the form of a conventional Ziploc TM closure or any other type of releasable closure whereby the containers 12 may be closed, opened and closed again as desired.

Second containers 14 are preferably similarly formed as first containers 12, except that second containers 14 are of a size for reception within first container 12. Thus, second containers 14 have three closed sides, together with a fourth releasably closed side or end edge. The closure may, for example, constitute a Ziploc TM closure or any other type of closure capable of retaining medication within the second container. The second containers are thus adapted to received medications and a plurality of such second containers 14 are adapted for disposition within each of first containers 12. While the first containers are preferably formed of a clear plastic material, the second containers 14 may be formed of a paper material or a clear plastic material, or other material as desired, and need not be formed of the same material as the first containers.

In accordance with the present invention, indicia is provided on each of first containers 12. For example, when containers 12 are formed of clear plastic material, it is preferable to provide a paper sheet within container 12, bearing appropriate indicia, as will be described. Alternatively, the first containers 12, when formed of paper material or other material on which writing may be easily effected, need not be provided with a separate sheet of paper. In this latter form, indicia may be provided directly on the outside surface of the first containers or on an adhesive label secured to the outside of containers 12. It will also be appreciated that indicia may be provided directly on the containers 12 when formed of plastic material.

Figure 2:
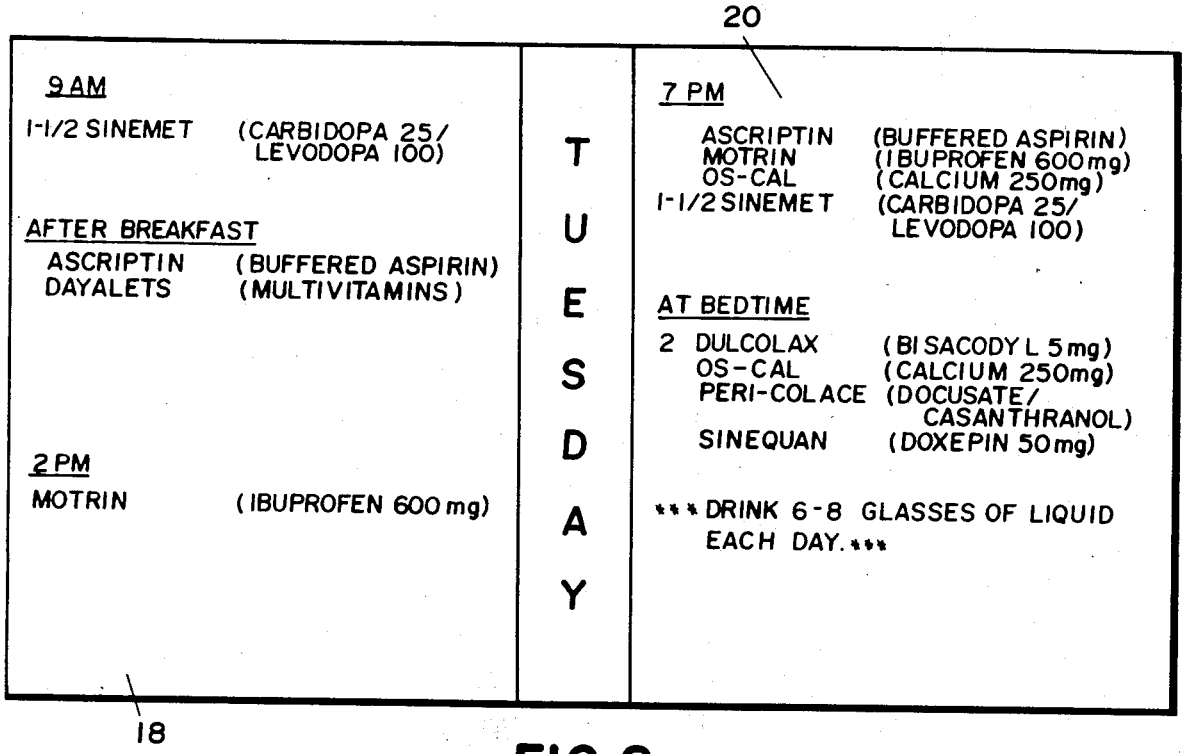
FIG. 2 is a front elevational view of a first container forming part of a medication compliance packaging system hereof and illustrating indicia provided as part of the first container.

In the illustrated embodiment of the present invention, the indicia provided on each of the paper sheets 18 disposed within the first containers at least bears an indicator of the day of the week. .For example, the first container 12 of the set thereof illustrated in FIG. 1 bears indicia for the day Monday. Preferably, a set of first containers 12 are provided with each container 12 of the set having a paper indicia indicating a different day of the week, whereby a week's supply of medications may be provided in the set as described below. Optionally, each paper sheet 18 bearing indicia indicative of the day of the week may also bear additional indicia 20, for example, indicating the nature of the medication contained in the second containers 14 within that first container. Indicia set 18 of the first containers 12 may also bear the schedule of times at which the various medications are to be taken as illustrated in FIG. 2. However, it is only necessary in keeping with the present invention that each of the containers of the first set bear day of the week indicia.

In accordance with the present invention, each of the first containers 12 has a window by which the interior of the container can be viewed. In the form illustrated in FIG. 1, the window may comprise the transparent material of the first containers 12 formed along the reverse or back side of the container from the indicia-bearing paper sheet 18. In other forms of the present invention, for example, where an opaque paper is used for forming the first containers, a window, such as used in a standard paper envelope, may be provided for viewing the interior of the container. Such window may be open or closed by a transparent material. Also, the window may lie on either side of the container.

Figure 3:
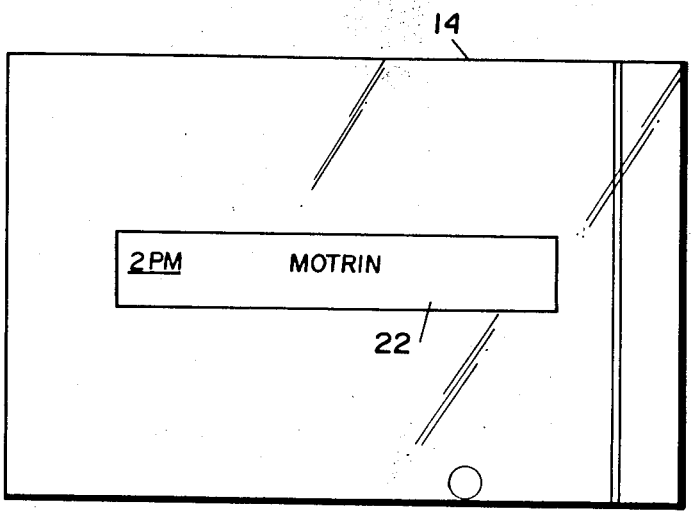
FIG. 3 is a front elevational view of a second container for insertion in the first container in accordance with the present invention.

Second containers 14 are also provided with indicia 22 as illustrated in FIGS. 1 and 3. Such indicia may be formed on a paper sheet disposed inside the container 14, may be provided on an adhesive-type label adhesively secured to the inside or the outside of the second container or may be provided directly on the plastic transparent material forming the body of the second container. Importantly, and in accordance with the present invention, the indicia on the second container constitutes the time of day at which the medication disposed within that particular container 14 is to be taken. Other indicia may be provided as well, for example, the nature of the medication, number of pills or tablets, or other informative indicia.

As will be appreciated, the second containers 14 are disposed in the first containers 12. Particularly, the second containers 14 are first arranged in chronological order of the time in which the medication contained therein is to be taken by the patient. The second containers 14 are also arranged such that the indicia which bears the indication of such time is exposed for viewing from one side of the second container, starting with the chronologically earliest time. This group of second containers 14 containing the medication prescribed for ingestion at the various indicated times are disposed in the first container 12 which bears indicia indicating the day of the week during which such medication is to be taken. Particularly, the second containers 14 are first disposed in chronological order of their indicia.

The second containers are then disposed in the associated first container with the indicia of the second container containing the medication to be taken the first scheduled time during the day indicated by the first container exposed to view through the window, e.g., the transparent back material of the first container. Consequently, when the second containers are individually removed in chronological sequence, in accordance with the time schedule disclosed through the window, the indicia of each second container next to be removed appears through the window of the first container each time a second container is removed. Assurance is thereby given by the sequential removal of the second containers that the medication carried by each removed second container has been taken at the time indicated on the indicia of the removed second container. Thus, both under-medication and over-medication is precluded. Additionally, the time at which the next medication is to be taken is visible through the window of the first container, thereby ensuring that the patient knows when that medication is to be taken.

It will be appreciated that the present invention encompasses a set of first containers wherein windows with or without transparent material are provided on either side of the container. The second containers may be provided with indicia located such that, upon insertion into the first container, the indicia on the second containers are located for viewing through the window of the first container in the sequence in which they are removed. All of the indicia on both the first and second containers may be visible from one side of the first container or, alternatively, the indicia of the first container and the indicia of the second container may be visible from opposite sides of the first container.

Thus, it will be appreciated that the objects of the present invention are fully accomplished in that there has been provided a medical compliance system and procedure for ensuring the accuracy and timeliness of the medication and affording verification that the medication was, in fact, timely taken whereby both over-medication and under-medication of the patient may be precluded.

While the invention has been described in connection with what is presently considered to be the most practical and preferred embodiment, it is to be understood that the invention is not to be limited to the disclosed embodiment, but on the contrary, is intended to cover various modifications and equivalent arrangements included within the spirit and scope of the appended claims.

What is claimed is:

1. Medication compliance packaging system comprising:

a first container having an opening;

indicia carried by said first container indicative of a day of the week;

a plurality of discrete second containers for disposition within said first container and adapted to contain medication, said second container being removable from said first container through said opening; and indicia carried by said second containers indicative of the times of said day that the respective medications of the said second containers are to be taken by a patient whereby medications may be accurately dosed from said packaging system at the proper time during that day, said first container having at least a portion thereof defining a window for viewing the interior of said first container, said second containers being disposed in said first container in chronological order of their indicia with such indicia located chronologically one behind the other and with the second container bearing the earliest indicia located to expose its indicia through said viewing window such that, as the second containers are individually removed form the first container in chronological sequence, the indicia of each second container next to be removed appears through said viewing window of said first container.

2. Packaging according to claim 1 wherein the indicia carried by said first container also indicates the nature of the medication carried within said second containers for use the day.

3. Packaging according to claim 1 wherein the indicia carried by each of said second containers also indicates the nature of the medication carried thereby.

4. Packaging according to claim 1 wherein at least one of said first container or said second containers is formed of transparent material.

5. Packaging according to claim 1 including releasable closing means carried by said first container for selectively opening and closing said first container to provide access to said second containers and enabling their removal from said first container.

6. Packaging according to claim 1 wherein the indicia carried by said first container also indicates the nature of the medication carried within said second containers for use that day, the indicia carried by each of said containers also indicating the nature of the medication carried thereby.

7. Packaging according to claim 6 wherein said first container has a releasable closing means carried by said first container for selectively opening and closing said first container to provide access to said second containers and enable their removal from said first container.

8. Packaging according to claim 1 wherein each of said first and second containers is formed of flexible material thereby facilitating transport of the first container with said second containers therein.

9. Medication compliance packaging comprising:

a set of first containers each having an opening;

indicia carried by said first container indicative of successive days of the week, respectively;

a plurality of discrete second containers disposed within each of said first containers and adapted to contain medication, said second containers being removable from said first container through said opening; and indicia carried by each of said second containers indicative of the time of day that the medication of the second containers is to be taken by a patient whereby medications may be accurately dosed at the scheduled time during each day of that week, wherein each of said first containers has at least a portion thereof defining a window for viewing the interior of said first container, said second containers being disposed in said first containers in chronological order of their indicia with such indicia located chronologically one behind the other and with the second containers bearing the earliest indicia in each said first container disposed to expose its indicia through said viewing window such that, as the second containers are individually removed from the first containers in chronological sequence, the indicia of each second container next to be removed in chronological sequence appears through said viewing window of its first container.

10. Packaging according to claim 9 wherein the indicia carried by each of said first container also indicates the nature of the medication carried within said second containers for use that day.

11. A medication compliance procedure comprising the steps of:

providing a first container;

providing indicia for said first container indicative of the day of the week;

providing a plurality of second containers;

disposing medication in each of said second containers;

locating said second containers in said first container;

providing indicia for said second containers indicative of the times of day that the respective medications contained therein are to be taken by the patient whereby medication can be accurately dosed at scheduled times during that day;

forming a window in said first container for viewing the interior thereof, exposing the indicia of one of said second containers for viewing through said window; and locating said second containers in said first container in chronological order of their indicia with the second container bearing the earliest indicia located to expose its indicia through said window and removing the second containers individually in chronological sequence such that the indicia of the next-to-be removed second containers appears in said window.

* * * * *